US010141671B2

(12) United States Patent
Adachi et al.

(10) Patent No.: US 10,141,671 B2
(45) **Date of Patent: *Nov. 27, 2018**

(54) REVERSIBLE CONNECTOR INTERFACE

(71) Applicant: International Business Machines Corporation, Armonk, NY (US)

(72) Inventors: Yuta Adachi, Tokyo (JP); Yutaka Kawai, Tokyo (JP); Yohichi Miwa, Yokohama (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/485,254

(22) Filed: Apr. 12, 2017

(65) Prior Publication Data

US 2018/0301840 A1 Oct. 18, 2018

(51) Int. Cl.
*H01R 27/00* (2006.01)
*H01R 13/24* (2006.01)
(Continued)

(52) U.S. Cl.
CPC ..... *H01R 13/2442* (2013.01); *H01R 13/2421* (2013.01); *H01R 13/62916* (2013.01);
(Continued)

(58) Field of Classification Search
CPC ..... H01R 13/6658; H01R 4/34; H01R 27/00; H01R 33/02; H01R 23/6873; H01R 13/658; H01R 23/7073
(Continued)

(56) References Cited

U.S. PATENT DOCUMENTS 6,106,338 A * 8/2000 Wu ..... H01R 4/028 439/660
6,981,887 B1 * 1/2006 Mese ..... H01R 29/00 439/244

(Continued)

FOREIGN PATENT DOCUMENTS

| | | | |
|---|---|---|---|
| CN | 101636884 | A | 1/2010 |
| JP | 2008508694 | A | 3/2008 |
| JP | 2010510640 | A | 4/2010 |

OTHER PUBLICATIONS

"Wurth WR-COM Reversible USB 2.0 Connector", Mouser Electronics, Copyright © 2017 Mouser Electronics, Inc., 2 pages.

(Continued)

*Primary Examiner* — Thanh Tam Le
(74) *Attorney, Agent, or Firm* — Alexander G. Jochym

(57) ABSTRACT

A reversible plug connector includes a plug housing having a housing contact disposed on an inner surface of the plug housing, a moveable plug insulator disposed within the plug housing, the moveable plug insulator having an upper surface and a lower surface opposite the upper surface with a metallic conductor exposed on both the upper surface and the lower surface. The moveable plug insulator is configured to be vertically displaced in response to the reversible plug connector being inserted into a receptacle connector such that a portion of the metallic conductor is brought into contact with a receptacle contact on the receptacle connector and another portion of the metallic conductor is brought into contact with the housing contact, and thereby the housing contact is electrically connected to the receptacle contact. A corresponding system is also disclosed herein.

19 Claims, 5 Drawing Sheets

(51) Int. Cl.
*H01R 13/629* (2006.01)
*H01R 24/62* (2011.01)
*H01R 107/00* (2006.01)

(52) U.S. Cl.
CPC ..... *H01R 24/62* (2013.01); *H01R 2107/00* (2013.01); *H01R 2201/06* (2013.01)

(58) Field of Classification Search
USPC ..... 439/76.1, 217, 218, 244, 607.35, 607.4, 439/607.41, 607.46, 660
See application file for complete search history.

(56) References Cited

U.S. PATENT DOCUMENTS 7,094,086 B2 * 8/2006 Teicher ..... H01R 27/00 439/173
7,359,208 B2 * 4/2008 Ni ..... G11B 33/12 174/50.51
7,387,539 B2 6/2008 Trenne
7,467,977 B1 * 12/2008 Yi ..... H01R 12/7023 439/541.5
7,537,471 B2 * 5/2009 Teicher ..... H01R 13/64 439/172
7,553,172 B2 6/2009 Chiu et al.
7,789,706 B2 * 9/2010 Chen ..... H01R 13/504 439/607.35
8,198,563 B2 * 6/2012 Tsai ..... H01R 23/10 218/118
9,028,269 B2 * 5/2015 Hsu ..... H01R 13/6582 439/357
9,065,231 B2 * 6/2015 Cho ..... H01R 24/62
9,142,926 B2 * 9/2015 Tsai ..... H01R 24/60
9,209,543 B2 * 12/2015 Yokoyama ..... H01R 12/725
9,231,344 B1 1/2016 Liao
9,350,125 B2 5/2016 Jones et al.
2008/0274633 A1 11/2008 Teicher
2014/0235095 A1 8/2014 Jones et al.
2017/0033496 A1 2/2017 Golko et al.

OTHER PUBLICATIONS

Adachi et al., "Reversible Connector Interface", U.S. Appl. No. 15/887,102, filed Feb. 2, 2018, 19 pages.
IBM Appendix P, list of patents and patent applications treated as related, filed herewith, 2 pages.

* cited by examiner

REVERSIBLE CONNECTOR INTERFACE

BACKGROUND OF THE INVENTION

The present invention relates generally to the field of electrical connectors, and more particularly to USB connectors.

Numerous USB connectors are currently available and widely used in various electronic devices. According to the specifications of existing USB connectors, the insulator portion of each mating connector is fixed at a specified non-centered vertical position in order to prevent erroneous mating of the connectors and ensure proper mating of the electrical contacts of the connectors. However, users may be unaware of, or unable to achieve, the required orientation and experience frustration at trying to mate the connectors properly.

SUMMARY

A reversible plug connector includes a plug housing having a housing contact disposed on an inner surface of the plug housing, a moveable plug insulator disposed within the plug housing, the moveable plug insulator having an upper surface and a lower surface opposite the upper surface with a metallic conductor exposed on both the upper surface and the lower surface. The moveable plug insulator is configured to be vertically displaced in response to the reversible plug connector being inserted into a receptacle connector such that a portion of the metallic conductor is brought into contact with a receptacle contact on the receptacle connector and another portion of the metallic conductor is brought into contact with the housing contact, and thereby the housing contact is electrically connected to the receptacle contact. A corresponding system includes the above apparatus and one or more elements of a computing system such as a processor, a memory, and an I/O device.

DETAILED DESCRIPTION

According to the current USB Type-A specification, connector insulator portions are fixed both on the receptacle side and the plug side, so that the latter can only be inserted into the former in one predefined orientation (as long as their designs are compliant with the specification). Also, a product that includes a plug whose insulator portion is fixed and vertically centered is not compliant with the specification.

Consequently, such a cannot be inserted into a receptacle or a bad electrical contact may result even when the plug is allowed to be inserted into the receptacle.

Various embodiments of the present invention will now be described in reference to the Figures. The embodiments disclosed herein address at least some of the above issues.

In order to solve these problems, an insulator of a plug connector is adapted to be vertically movable. Further, as illustrated in the Figures and described below, pins are arranged on the upper and lower sides of the plug housing, and a metallic member is arranged at the insulator portion, by virtue of which the plug can be inserted into the receptacle in an normal orientation or reverse orientation from the USB 3.1 specification and excellent durability of the product can be achieved.

Figure 1:
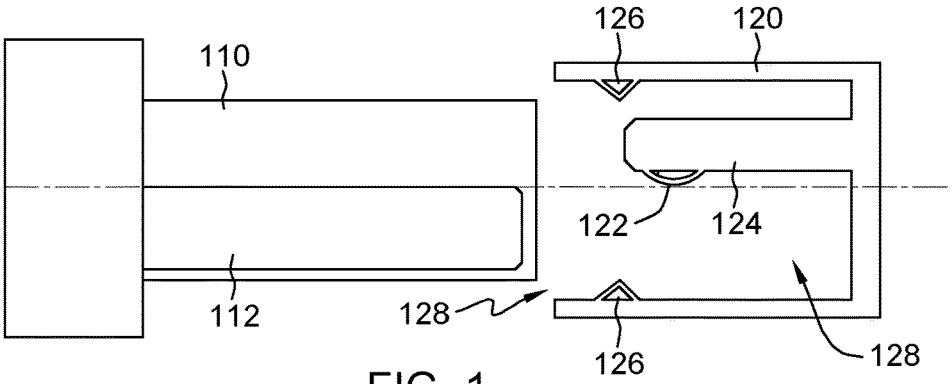
FIG. 1 PRIOR ART
FIG. 1 is a cross-sectional view illustration of a prior art plug connector and corresponding receptacle connector.

FIG. 1 is a cross-sectional view illustration of a prior art plug connector 110 and corresponding receptacle connector 120. The plug connector 110 includes an insulator portion 112 with pads formed thereon (not shown) that mate with contacts 122 formed on an insulator portion 124 of the receptacle connector 120. The receptacle connector 120 may also include one or more guides 126. The insulator portion 112 is vertically offset to align with, and insert into, a receiving cavity 128 in the receptacle connector 120 when the plug connector 110 is mated with the receptacle connector 120.

According to the current USB Type-A specification, which is applicable to the plug connector 110 and receptacle connector 120, insulator portions are fixed on both the receptacle side and the plug side, so that the latter can only be inserted into the former in one predefined orientation as long as their designs are compliant with the specification. Also, a product that includes a plug whose insulator portion is fixed at its vertical centerline is not compliant with the specification. Consequently, a plug whose insulator portion is fixed at its vertical centerline cannot normally be inserted into a receptacle and a bad electrical contact may result even when the plug is (forcibly) inserted into the receptacle.

Figure 2A:
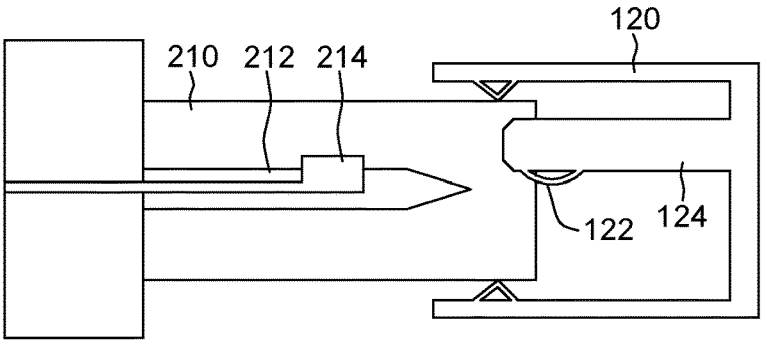
FIG. 2A PRIOR ART
FIGS. 2A and 2B are cross-sectional view illustrations of a flexible plug connector that may be reversibly inserted into the prior art receptacle connector of FIG. 1.
Figure 2B:
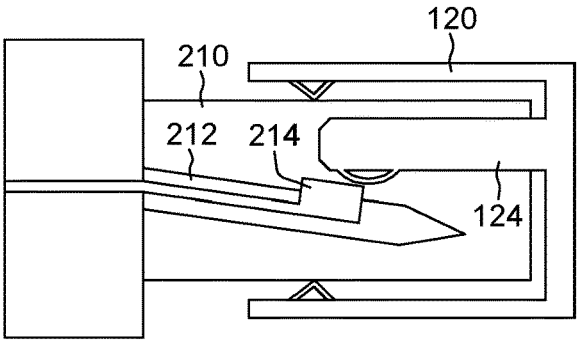
FIG. 2B PRIOR ART

FIGS. 2A and 2B are cross-sectional view illustrations of a flexible plug connector 210 that may be reversibly inserted into the prior art receptacle connector 120. To achieve reversibility, an insulator portion 212 is tapered and engineered to flex so that the insulator 212 can be vertically centered and deflected (angled) upward or downward. The deflection may be sufficient to provide contact between one or more contacts 214 formed on the insulator portion 212 and the contacts 122 formed on the insulator portion 124 of the receptacle connector 120. However, the flexible plug connector 210 may not provide a consistent electrical connection and may not be durable due to the repeated flexing of the insulator 212.

Figure 3A:
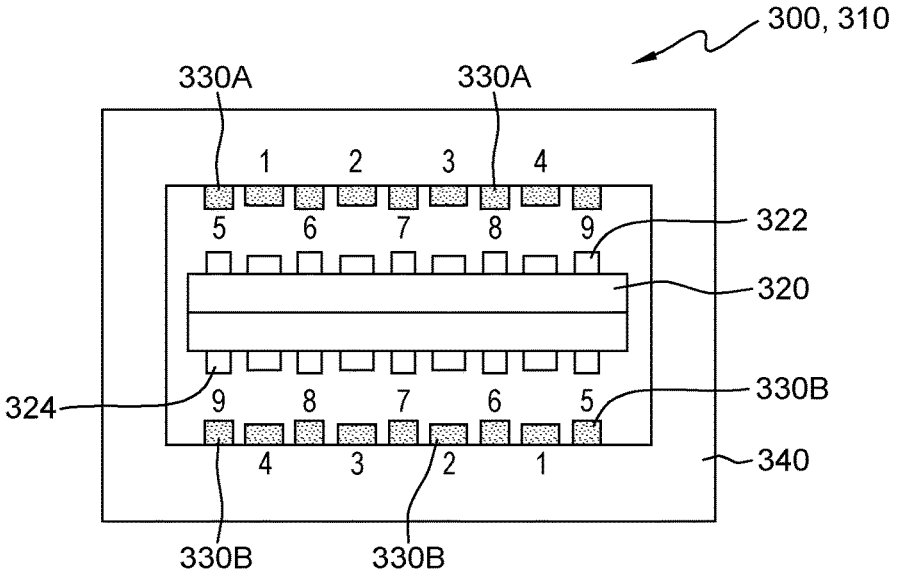
FIGS. 3A and 3B are cross-sectional end view illustrations of one embodiment of a reversible plug connector of the present invention.
Figure 3B:
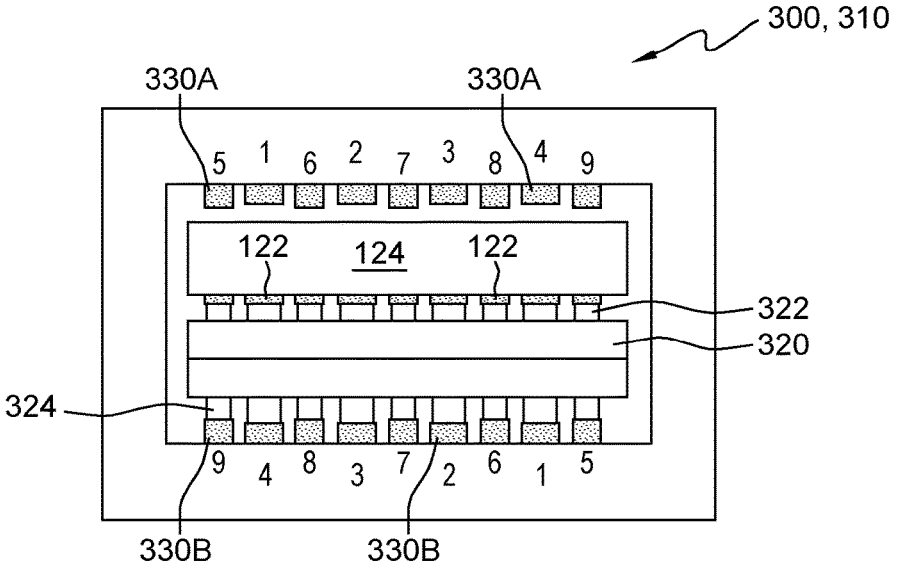
Figure 4:
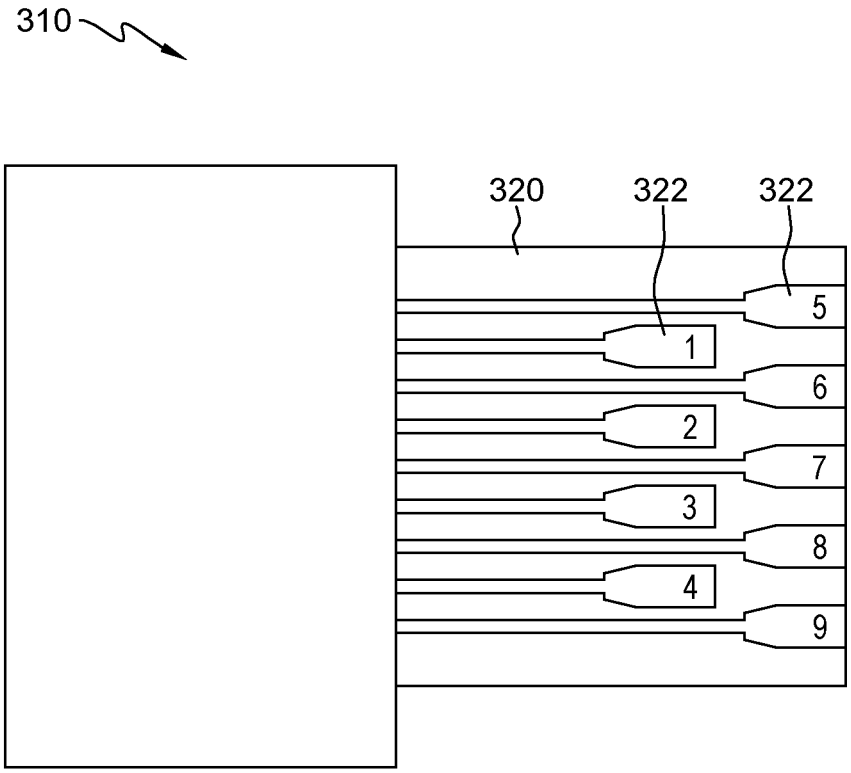
FIG. 4 is a top view illustration of one embodiment of the reversible plug connector of FIG. 3.
Figure 5A:
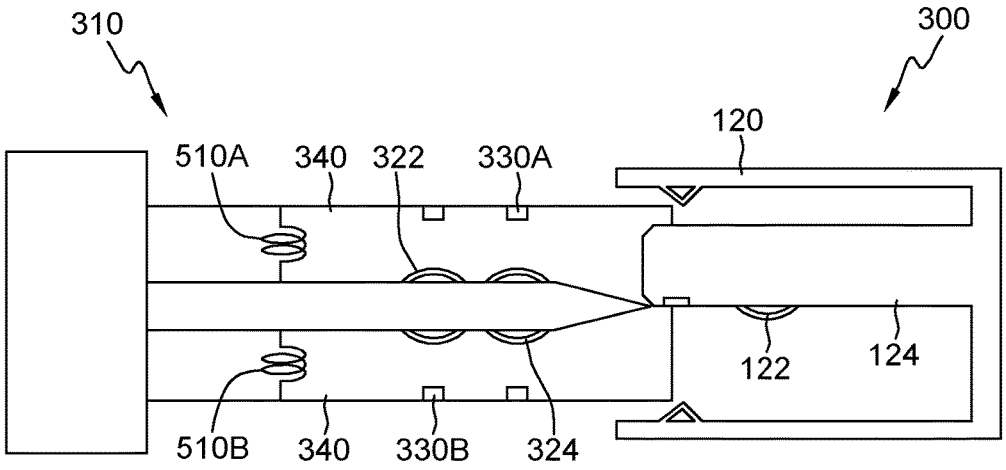
FIGS. 5A and 5B are cross-sectional side view schematic illustrations of a reversible plug connection system in accordance with at least one embodiment of the present invention.
Figure 5B:
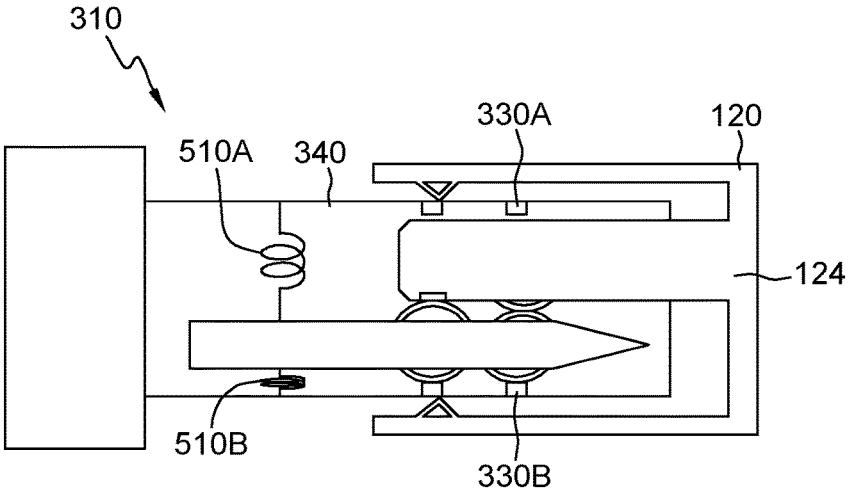

FIGS. 3A and 3B are cross-sectional end view illustrations, FIG. 4 is a top view illustration and FIGS. 5A and 5B are cross-sectional side view schematic illustrations of elements of one embodiment of a reversible plug connection system 300 of the present invention.

Referring particularly to FIGS. 3A and 3B, the depicted reversible plug connection system 300 includes a reversible plug connector 310 comprising a movable insulator portion 320 that is vertically deflectable and provides an electrical connection between contacts 330 formed on an outer shell 340 and contacts 122 formed on an inserted insulator portion 124. Instead of flexing like the insulator portion 212 shown in FIG. 2B, the movable insulator portion 320 is vertically impelled (as a whole) in response to insertion of the inserted insulator portion 124. To provide the electric connection, the movable insulator portion 320 may have upper contacts 322 and lower contacts 324 that provide a conduction path between contacts 330 formed on the outer shell 340 and contacts 122 on the inserted insulator portion 124. In one embodiment, each upper contact 322 electrically connects to a lower contact 324 that is directly below each upper contact 322.

FIG. 4 is a top view illustration of one embodiment of the reversible plug connector 310 of FIG. 3. As depicted, the upper contacts 322 and lower contacts 324 (blocked from view) may be arranged on the moveable insulator portion 320 in a manner that conforms to the USB 3.1 specification. Consequently, functional connections may be made with the upper contacts 322, or the lower contacts 324, depending on whether the orientation of the plug connector is reversed relative to the receptacle connector.

Referring to FIGS. 5A and 5B, a movable insulator portion 320 may be suspended in place by one or more spring elements 510. In the depicted embodiment, the spring elements 510 include an upper spring 510A and a lower spring 510B. The spring elements 510 maintain the movable insulator portion 320 in a suspended neutral position proximate to the vertical centerline of the reversible plug connector 310 when the reversible plug connector 310 is not inserted into the receptacle connector 120 (see FIG. 5A).

In response to insertion of the reversible plug connector 310 into the receptacle connector 120 (see FIG. 5B), the movable insulator portion 320 is impelled to align with the receiving cavity 128. Consequently, with the depicted insertion orientation the upper contacts 322 on the movable insulator portion 320 come into contact with the contacts 122 on the inserted insulator portion 124 and the lower contacts 324 come into contact with the contacts 330B formed on the plug shell 340. If the orientation of the reversible plug connector 310 is flipped along the vertical centerline, insertion into the plug receptacle 120 causes the lower contacts 324 (which are now above the insulator portion 320) to come into contact with the contacts 122 on the inserted insulator portion 124 and the upper contacts 322 (which are now below the insulator portion 320) to come into contact with the contacts 330A formed on the plug shell 340.

Figure 6A:
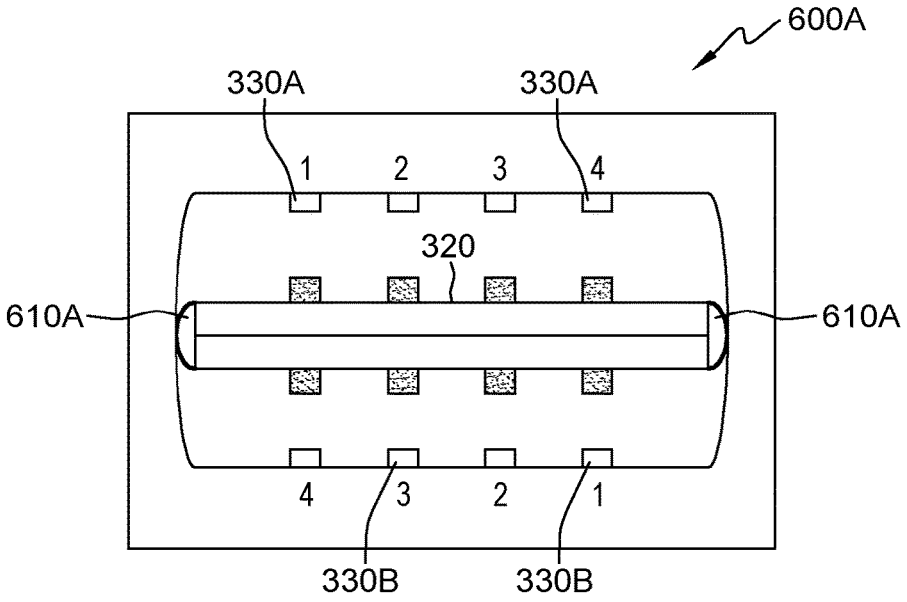
FIGS. 6A and 6B are end view illustrations of two embodiments of a reversible plug connector in accordance with at least one embodiment of the present invention.
Figure 6B:
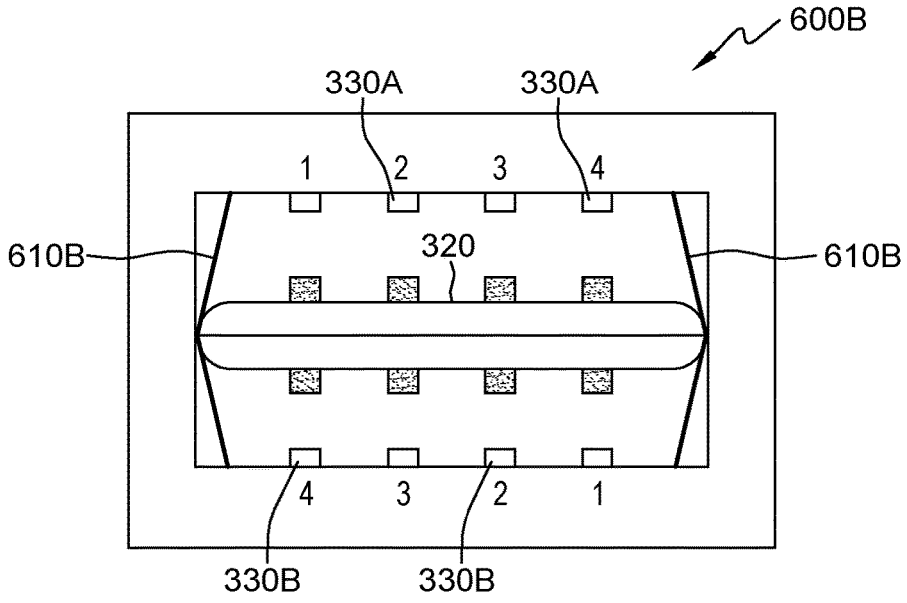

FIGS. 6A and 6B are end view illustrations of two embodiments of a reversible plug connector 600 in accordance with at least one embodiment of the present invention. Although FIGS. 5A and 5B illustrate spring elements that are vertically stacked with the insulator, the mode of implementation of the spring elements is not limited to a vertically stacked arrangement. For example, as illustrated in FIGS. 6A and 6B the reversible plug connector 600 may include one or more spring elements 610 disposed between a sidewall of the plug housing and a sidewall of the moveable plug insulator 320.

FIG. 6A shows a spring element 610A that is attached to the movable insulator portion 320 and opposes (but does not prevent) displacement from the vertical centerline of the connector 600A via interaction of the spring element 610A with the shape of the sidewalls of the connector shell. FIG. 6B shows a spring element 610B that is attached to the movable insulator portion 320 and opposes (but does not prevent) displacement from the vertical centerline of the connector 600B via interaction of the shape of the spring element 610A with the sidewalls of the movable insulator portion 320.

The moveable plug insulator 320 may move in a direction away from a vertically neutral position (e.g., the vertical center line) of the reversible plug connector in response to the reversible plug connector 600 being connected to a receptacle connector. The spring elements 610 may impel the moveable plug insulator 320 toward the vertical center line of the reversible plug connector 600 in response to removal of the reversible plug connector 600 from the receptacle connector.

One of skill in the art will appreciate that in contrast to an arrangement according to which pins are arranged in an insulator portion, the present invention includes a mechanism in which a metallic member is provided in the insulator portion and pins are vertically symmetrically arranged in the connector as illustrated in FIGS. 3A, 3B, 4, 5A and 5B. According to this mechanism, since the portion where the wiring connections of the pins are provided is stationary even when the insulator portion as such is movable, it can be said that the present invention is superior in its durability. As a result, it is made possible to achieve a USB Type-A connector of reversible plug connection.

Further, since the insulator portion of the present invention is vertically movable by a spring, the present invention has compatibility with the USB 2.0 specification while supporting the USB 3.1 specification according to which the pins are longitudinally arranged on the insulator.

One of skill in the art will appreciate that the present invention provides a reversible plug connector that is connectable to a receptacle connector such as a USB 3.1 receptacle connector that has a receptacle housing and a fixed receptacle insulator extending within the receptacle housing. The fixed receptacle insulator may include one or more receptacle contacts disposed on one of surfaces of the fixed receptacle insulator.

The reversible plug connector may include a plug housing with a housing contact disposed on an inner surface of the plug housing, a moveable plug insulator disposed within the plug housing that has an upper surface and a lower surface that is placed opposite to the upper surface. The reversible plug connector may also include one or more metallic conductors exposed on both the upper surface and the lower surface of the moveable plug insulator.

The moveable plug insulator may be configured to be vertically displaced in response to the reversible plug connector being inserted into the receptacle connector such that a portion of each metallic conductor is brought into contact with one of the receptacle contacts and another portion of the metallic conductor is brought into contact with one of the housing contacts. Consequently, each housing contact housing contact may be electrically connected to a corresponding receptacle contact. The movable plug insulator may be detached from a rear portion of the plug housing.

The fixed receptacle insulator and the moveable plug insulator may be brought into contact with each other in response to the reversible plug connector being connected to the receptacle connector. The moveable plug insulator may be configured to be moved by an elastic body such as a spring element provided above, below or beside the moveable plug insulator. The moveable plug insulator may be adapted to be vertically movable by a combination of a leaf spring mounted on the moveable plug insulator and a shape of the housing or a combination of a shape of the insulator and a leaf spring mounted on the housing.

The fixed receptacle insulator may include two or more receptacle contacts and the moveable plug insulator may include a corresponding set of metallic conductors each of which corresponds to one of the receptacle contacts. Furthermore, the plug housing may include two or more housing contacts that each correspond to one of the receptacle contacts. The metallic conductors may be exposed on the upper and lower surface of the moveable plug insulator in accordance with USB 3.1 specifications. The reversible plug connector may be deployed in a system that includes one or more of a processor, a memory, and an I/O device.

It should be noted that this description is not intended to limit the invention. On the contrary, the embodiments presented are intended to cover some of the alternatives, modifications, and equivalents, which are included in the spirit and scope of the invention as defined by the appended claims. Further, in the detailed description of the disclosed embodiments, numerous specific details are set forth in order to provide a comprehensive understanding of the claimed invention. However, one skilled in the art would understand that various embodiments may be practiced without such specific details.

Although the features and elements of the embodiments disclosed herein are described in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A reversible plug connector connectable to a receptacle connector, the receptacle connector having a receptacle housing and a fixed receptacle insulator extending within the receptacle housing, the fixed receptacle insulator including a plurality of receptacle contacts on one surface of one or more surfaces of the fixed receptacle insulator, the reversible plug connector comprising:

an insulative plug housing having a plurality of housing contacts disposed on an upper inner surface of the plug housing and on a lower inner surface of the plug housing;

a moveable plug insulator disposed within the plug housing, the moveable plug insulator having an upper surface and a lower surface opposite the upper surface with a plurality of metallic conductors exposed on both the upper surface and the lower surface of the moveable plug insulator;

wherein the moveable plug insulator is configured to be vertically displaced in response to the reversible plug connector being inserted into the receptacle connector such that a portion of each metal conductor of the plurality of metallic conductors is brought into contact with a corresponding receptacle contact of the plurality of receptacle contacts and another portion of each metal conductor of the plurality of metallic conductors is brought into contact with a corresponding housing contact of the plurality of housing contacts, and thereby the corresponding housing contact of the plurality of housing contacts is electrically connected to the corresponding receptacle contact of the plurality of receptacle contacts;

at least two spring elements attached to the moveable insulator oppose displacement from a centerline of the reversible plug connector via an interaction of the at least two spring elements with a shape of two inner sidewalls of the plug housing; and wherein each spring element of the at least two spring elements is disposed directly between a sidewall of the two inner sidewalls of the insulative plug housing and a sidewall of the moveable plug insulator.

2. The reversible plug connector according to claim 1, wherein the movable plug insulator is detached from a rear portion of the plug housing.

3. The reversible plug connector according to claim 1, wherein the fixed receptacle insulator is offset from a vertical center line of the receptacle housing.

4. The reversible plug connector according to claim 1, wherein the fixed receptacle insulator and the moveable plug insulator are brought into contact with each other in response to the reversible plug connector being connected to the receptacle connector.

5. The reversible plug connector according to claim 1, wherein the moveable plug insulator is moved in a direction away from a vertical center line of the reversible plug connector in response to the reversible plug connector being connected to the receptacle connector.

6. The reversible plug connector according to claim 1, wherein the moveable plug insulator is configured to be moved vertically by the at least two spring elements provided beside the moveable plug insulator.

7. The reversible plug connector according to claim 6, wherein a spring element is an elastic body.

8. The reversible plug connector according to claim 1, wherein the moveable plug insulator is configured to be vertically movable by a combination of the at least two spring elements mounted on the moveable plug insulator and a curved shape of the two inner sidewalls of the plug housing, wherein the two inner sidewalls of the plug housing are vertical sidewalls.

9. The reversible plug connector according to claim 1, wherein when the reversible plug connector is connected to the receptacle connector, the fixed receptacle insulator includes the plurality of receptacle contacts on the one surface of the one or more surfaces of the fixed receptacle insulator each receptacle contact corresponding to a metallic conductor of the plurality of metallic conductors on the moveable plug housing and the moveable plug insulator includes the plurality of metallic conductors with each metallic conductor corresponding to one receptacle contact of the plurality of receptacle contacts and to one housing contact of the plurality of plug housing contacts.

10. The reversible plug connector according to claim 1, wherein the plurality of metallic conductors are exposed in accordance with USB 3.1 specifications.

11. The reversible plug connector according to claim 1, wherein the at least two spring elements impel the moveable plug insulator toward a vertical center line position in response to removal of the reversible plug connector from the receptacle connector.

12. A system comprising:

a processor;

a memory;

an I/O device; and a reversible plug connector comprising:

an insulative plug housing having a plurality of housing contacts disposed on an upper inner surface of the plug housing and on a lower inner surface of the plug housing;

a moveable plug insulator disposed within the plug housing, the moveable plug insulator having an upper surface and a lower surface opposite the upper surface with a plurality of metallic conductors exposed on both the upper surface and the lower surface of the moveable plug insulator;

wherein the moveable plug insulator is configured to be vertically displaced in response to a reversible plug connector being inserted into a receptacle connector such that a portion of each metallic conductor of the plurality of metallic conductors is brought into contact with a corresponding receptacle contact of a plurality of receptacle contacts disposed on a fixed receptacle insulator of the receptacle connector and another portion of each metallic conductor of the plurality of metallic conductors is brought into contact with a corresponding housing contact of the plurality of housing contacts, and thereby the corresponding housing contact is electrically connected to the corresponding receptacle contact of a plurality of receptacle contacts;

at least two spring elements attached to the moveable plug insulator oppose displacement from a centerline of the reversible plug connector via interaction of the at least two spring elements with a shape of two inner sidewalls of the plug housing; and wherein each spring element of the at least two spring elements is disposed directly between a sidewall of the two inner sidewalls of the insulative plug housing and a sidewall of the moveable plug insulator.

13. The system according to claim 12, wherein the movable plug insulator is detached from a rear portion of the plug housing.

14. The system according to claim 12, wherein the fixed receptacle insulator is offset from a vertical center line of the receptacle connector.

15. The system according to claim 12, wherein the fixed receptacle insulator and the moveable plug insulator are brought into contact with each other in response to the reversible plug connector being connected to the receptacle connector.

16. The system according to claim 12, wherein the moveable plug insulator is moved in a direction away from a vertical center line of the reversible plug connector in response to the reversible plug connector being connected to the receptacle connector.

17. The system according to claim 12, wherein the at least two spring elements impel the moveable plug insulator toward a vertical center line position in response to removal of the reversible plug connector from the receptacle connector.

18. A reversible plug connector connectable to a receptacle connector, the receptacle connector having a receptacle housing and a fixed receptacle insulator extending within the receptacle housing, the fixed receptacle insulator including a plurality of receptacle contacts on one surface of one or more surfaces of the fixed receptacle insulator, the reversible plug connector comprising:

a plug housing having a plurality of housing contacts disposed on an upper inner surface of the plug housing and on a lower inner surface of the plug housing;

a moveable plug insulator disposed within the plug housing, the moveable plug insulator having an upper surface and a lower surface opposite the upper surface with a plurality of metallic conductors exposed on both the upper surface and the lower surface of the moveable plug insulator;

wherein the moveable plug insulator is configured to be vertically displaced in response to the reversible plug connector being inserted into the receptacle connector such that a portion of each metal conductor of the plurality of metallic conductors is brought into contact with a corresponding receptacle contact of the plurality of receptacle contacts and another portion of each metal conductor of the plurality of metallic conductors is brought into contact with a corresponding housing contact of the plurality of housing contacts, and thereby the corresponding housing contact is electrically connected to the corresponding receptacle contact; and at least two spring elements are each attached to the plug housing on the upper inner surface of the plug housing and on the lower inner surface of the plug housing surface and the at least two spring elements are each disposed between an inner sidewall of the plug housing and a sidewall of the moveable plug insulator such that the at least two springs oppose displacement from a vertical centerline of the reversible plug connector.

19. The reversible plug connector according to claim 18, wherein the moveable plug insulator is moved in a direction away from the vertical center line of the reversible plug connector in response to the reversible plug connector being connected to the receptacle connector.

* * * * *